US008134119B2

(12) United States Patent
Panayi

(10) Patent No.: US 8,134,119 B2
(45) Date of Patent: Mar. 13, 2012

(54) REFLECTRON

(75) Inventor: Peter Panayi, Norfolk (GB)

(73) Assignee: Cameca Instruments, Inc., Mahwah, NJ (US)

( * ) Notice: Subject to any disclaimer, the term of this patent is extended or adjusted under 35 U.S.C. 154(b) by 104 days.

(21) Appl. No.: 12/425,291

(22) Filed: Apr. 16, 2009

(65) Prior Publication Data

US 2010/0006752 A1 Jan. 14, 2010

Related U.S. Application Data

(63) Continuation of application No. 11/913,343, filed as application No. PCT/GB2006/001694 on May 10, 2006.

(60) Provisional application No. 60/682,863, filed on May 20, 2005.

(30) Foreign Application Priority Data

May 11, 2005 (GB) ..... 0509638.3

(51) Int. Cl.
*H01J 49/00* (2006.01)

(52) U.S. Cl. ..... 250/281; 250/282; 250/286; 250/287

(58) Field of Classification Search ..... 250/281, 250/282, 286, 287
See application file for complete search history.

(56) References Cited

U.S. PATENT DOCUMENTS

| | | | | |
|---|---|---|---|---|
| 6,740,872 | B1 * | 5/2004 | Holle | 250/281 |
| 6,797,952 | B2 | 9/2004 | Kaito et al. | |
| 2007/0029473 | A1 * | 2/2007 | Verentchikov | 250/281 |

FOREIGN PATENT DOCUMENTS

| | | | |
|---|---|---|---|
| GB | 2 274 197 | A | 7/1994 |
| GB | 2274197 | A * | 7/1994 |

OTHER PUBLICATIONS

Cerezo, et al ("Performance of an energy-compensated three-dimensional atom probe", Rev. Sci. Instrum. 69(1):49-58 (1998).*
Cerezo et al., (1998) Performance of an energy-compensated three-dimensional atom probe, *Rev. Sci. Instrum.*, 69(1):49-58.
Scherer et al., (2006) A novel principle for an ion mirror design in time-of-flight mass spectrometry, *International Journal of Mass Spectrometry*, 251:73-81.

* cited by examiner

*Primary Examiner* — Michael Maskell
(74) *Attorney, Agent, or Firm* — Craig A. Fieschko, Esq.; DeWitt Ross & Stevens S.C.

(57) ABSTRACT

A reflectron (1) for deflecting an ion from a specimen in a time-of-flight mass spectrometer comprises a front electrode (2) and a back electrode (3). At least one of the front and back electrodes (2, 3) is capable of generating a curved electric field. The front and back electrodes are configured to perform time focusing and resolve an image of a specimen.

21 Claims, 4 Drawing Sheets

REFLECTRON

CROSS-REFERENCE TO RELATED APPLICATIONS

The present application is a Continuation of U.S. patent application Ser. No. 11/913,343, filed Nov. 11, 2007, which is a U.S. National Phase of International Patent Application No. PCT/GB2006/001694, filed May 10, 2006, which claims the benefit of priority to both United Kingdom Patent Application No. 0509638.3, filed May 11, 2005, and U.S. Provisional Patent Application No. 60/682,863, filed May 20, 2005. Each of these applications is hereby incorporated by reference in their entirety.

BACKGROUND

The present invention relates to a reflectron for a time-of-flight mass spectrometer, and more specifically an atom probe microscope.

Time-of-flight mass spectrometers typically include a specimen, a means to generate and liberate ions from the specimen and an electric field to attract these liberated ions to a detector. A means to measure the time between the initial ion liberation and the detection of the ion enables the measurement of transit time. The transit time is proportional to the mass-to-charge ratio of the ion, hence information about the atomic composition of the specimen can be determined.

These liberated ions have neither the same starting time nor the same kinetic energy. The spread in starting times is a function of the width of the initial ionizing pulse mechanism. The spread in kinetic energies for these ions results from the time-varying evaporation field present during ionization as well as the initial specimen geometry.

Time-of-flight mass spectrometers may incorporate a reflectron to improve the mass resolution of the device. The reflectron effectively acts as an electrostatic 'mirror', and alters the flight path of an ion which is being analyzed in the mass spectrometer. The ion is deflected from its initial direction from an ion source onto a detector.

A conventional reflectron is formed of a series of primarily planar ring electrodes, which define a hollow cylinder. The electrodes are each held at an electric potential, the potential increasing in a direction of travel of an ion from an ion source. The electrodes generate a uniform field over the cross-section of the reflectron. Indeed, the flatness of the fields is a key design criterion for conventional reflectrons. Any residual curvature of the fields, which is difficult to avoid, leads to aberrations in ion trajectories and degradation in mass resolution. The ions travel in a parabolic path through the reflectron. Ions with more kinetic energy travel farther into the reflectron, hence their path length is longer and their transit time to the detector is longer. Ions with less kinetic energy do not travel as deep, traverse a shorter path, and have shorter transit times. It can be deduced that ions with a given mass-to-charge ratio and varying kinetic energies will have less variation in their transit time, hence the measured mass resolution will be improved. The reflectron can be configured such that the time taken by the ion to travel through the atom probe is substantially independent of the initial energy of the ion. This is known as time focusing.

Ions liberated with the same mass-to-charge ratio but slightly different kinetic energies will follow different trajectories through the reflectron and will strike the detector at slightly different locations. The spread of impact positions is proportional to the chromatic aberration of the system. In addition, as the field of view (FOV) increases so does the chromatic aberration.

A reflectron with a curved rear electrode is evident in U.S. Pat. No. 6,740,872. In this embodiment, the curved electrode serves to space-angle focus a slightly-divergent point source to a point collector which improves the coupling efficiency between source and detector. There is no intent or prospect to collect information about the angular variation in intensity across the source, i.e., to resolve an image. Other embodiments (EP 0 208 894, U.S. Pat. No. 4,731,532) accomplish similar effects but with lesser operational flexibility. Keller and Srama et al. describe reflectrons that include dual shaped grids, but images are not being resolved.

The reflectron can increase the mass resolution of an atom probe microscope in a similar way to its use in a time-of-flight mass spectrometer. Further advances enable use of a reflectron in a three-dimensional atom probe—a microscope that yields atomistic imaging with spectroscopic information. What follows is a description of that particular embodiment.

The ion source in an atom probe microscope is a specimen under examination with a curved surface of small dimensions. The ions originate from a small area of the surface and proceed towards a detector at some distance away. They can form an image of the sampled area at a very large magnification if a position-sensitive detector is utilized. High mass resolutions are possible with small FOV configurations, while lower mass resolutions are possible with wider FOV arrangements.

While a conventional reflectron incorporated in an atom probe can increase the measured mass resolution it has the disadvantage that an angle spread of more than approximately 8 degrees results in an excessively large reflectron and detector or alternatively an excessively short flight path, hence the FOV is limited.

Another disadvantage of a conventional reflectron is that chromatic aberration results in a positioning error at the detector that increases with angle away from the reflectron's normal. Chromatic aberration is an error in the imaged position of the detected ion and is a function of the energy of the ion. The FOV of an atom probe employing a conventional reflectron to increase mass resolution is therefore usually limited to relatively small angles (approximately 8° included angle).

A reflectron used in a three-dimensional atom probe must accept ions over a significantly larger range of angles than a reflectron in a time-of-flight mass spectrometer. A reflectron designed for use in a traditional atom probe or a time-of-flight mass spectrometer will not be suitable for use in a three-dimensional atom probe if they will only accept and reflect ions incident over a small range of angles.

SUMMARY OF THE INVENTION

The present invention aims to address at least some of the problems associated with the prior art. Accordingly, the present invention provides a reflectron for reflecting an ion from an ion source in an atom probe, the reflectron comprising:

a front electrode;

and a back electrode;

wherein the electrodes are configured to perform time focusing of the ions and resolve an image.

The front electrode and back electrodes can be configured such that when an electric potential is applied to at least one of the electrodes an electric field is generated substantially equivalent to an electric field produced by a point charge, such that an ion incident on the reflectron is reflected.

The reflectron according to the present invention has improved space angle focusing of the ions over a wide range of angles. The reflectron of the present invention may also be configured to reduce or almost eliminate chromatic aberration.

While many configurations and shapes are possible the front electrode preferably has a concave surface facing the ion source. Advantageously, the concave surface of the front electrode may be curved with a constant radius of curvature or may be a more complex curvature.

The front electrode may take any suitable form but will typically comprise a mesh to improve focusing.

The front electrode is preferably held at ground potential but can be biased positive or negative with respect to ground.

The rear electrode is preferably held at a potential of at least approximately 1.08 times the mean energy of ions to be reflected, but other potentials are possible.

The back electrode preferably has a concave surface facing the ion source. Advantageously, the concave surface of the back electrode is preferably curved with a constant radius of curvature, but other orientations are possible.

The back electrode may take any suitable form but will typically be comprised of a plate.

In one embodiment, when the reflectron is incorporated in a three-dimensional atom probe, the radius of curvature of the front electrode is substantially equal to a distance between the front electrode and a detector for detecting ions in the three-dimensional atom probe.

In one embodiment, the radius of curvature of the back electrode is preferably substantially equal to the distance between the back electrode and the detector for detecting ions in the three-dimensional atom probe.

In one embodiment, a radius of curvature of the front electrode and a radius of curvature of the back electrode are such that the two electrodes are concentric.

The reflectron preferably typically contains a plurality of intermediate electrodes disposed between the front electrode and the back electrode. Each of the intermediate electrodes is preferably formed as an annulus.

Each of the intermediate electrodes is preferably held at an electric potential equivalent to the potential at their location which would be generated by the point charge simulated by the front electrode and back electrode.

The present invention also provides a three-dimensional atom probe incorporating a reflectron as herein described. In one embodiment, the front electrode preferably has a concave surface having a constant radius of curvature, the radius of curvature of the front electrode being substantially equal to a distance between the front electrode and a detector for detecting ions in the three-dimensional atom probe. Advantageously, the back electrode has a concave surface having a constant radius of curvature, the radius of curvature of the back electrode being substantially equal to a distance between the back electrode and a detector for detecting ions in the three-dimensional atom probe.

BRIEF DESCRIPTION OF THE DRAWINGS

An embodiment of the present invention will now be described, by way of example only, with reference to the accompanying Figures, in which.

DETAILED DESCRIPTION

Figure 1:
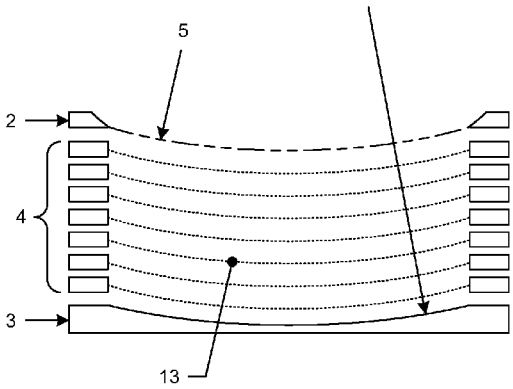
FIG. 1 is a plan view of the reflection of the present invention showing lines of equal electric potential.

A reflectron may be incorporated as part of a three-dimensional atom probe. A three-dimensional atom probe removes individual atoms from the surface of a needle shaped specimen with a small tip radius. The atom becomes an ion and is accelerated towards a detector plate which is as large as possible, and detects a position of the ion which corresponds with the position of the atom on the specimen surface. The detector electronics measure the position at which the ion hits the detector plate and also measures the mass/charge ratio of the resulting ion by measuring the TOF of the ion from the specimen to the detector.

The reflectron alters the direction of the ions, by generating an electric potential greater than the energy equivalent of the ion. An ion generally enters the reflectron at an angle to a radius line of the electrodes, so that the ion travels in an elliptical path through the reflectron. The detector is offset from a path of the ions from their source to the reflectron. In the limiting case of the conventional planar reflectron, the radius becomes the longitudinal axis of the reflectron and the ellipse becomes a parabola.

The reflection of the present invention is preferably configured such that the time taken to travel through the three-dimensional atom probe, including the time spent in the reflectron, is independent of the initial energy of the ion. This is known as time focusing, and improves the mass resolution of the spectrometer without introducing significant amounts of chromatic aberration.

A three-dimensional atom probe is used for examining the structure of materials, particularly metals and semiconductors at an atomic scale. A three-dimensional atom probe will incorporate timing means to measure the time taken for the ion to travel a predetermined distance within the three-dimensional atom probe. The ion travels through an electric field, and this TOF can be used to calculate the mass/charge ratio of the ion, and so determine its chemical identity. Three-dimensional atom probes, and their relationship to atom probes generally, are disclosed in the publication 'Atom Probe Field Ion Microscopy' by M. K. Miller, A. Cerezo, M. G. Hetherington and G. D. W. Smith, OUP 1996, which is incorporated herein.

In a three-dimensional atom probe, ions from the specimen sample are emitted from an area of the tip which depends on the curvature. They are emitted approximately radially to the tip curvature. A detector is located typically 80 to 600 mm from the tip. The detector is typically square or circular, and has a width in the order of 40 to 100 mm.

There is an area on the tip of the specimen from which ions emitted from the specimen will strike the detector. The ratio of the linear dimensions of the detected image and imaged area on the specimen is termed the magnification. The magnification is typically too large for optimum analysis of the specimen so it needs to be reduced. The magnification can be reduced by reducing the detector distance; by increasing the tip radius or by increasing the detector size. For practical reasons, the detector is limited in size; the tip radius is limited to between 50 and 100 nm, and the detector distance needs to be as large as possible. Thus, the best way to achieve a magnification decrease is to accept a fairly wide cone angle of emitted ions from the tip. This means however that a reflectron must function with a wide range of input angles. Typically 30 degrees or more would be desirable. For a conventional planar reflectron however the performance degrades both in mass resolution terms and from the point of view of chromatic aberration if the cone angle is much greater than 8 degrees. This also means that the detector distance would be undesirably short.

Figure 2:
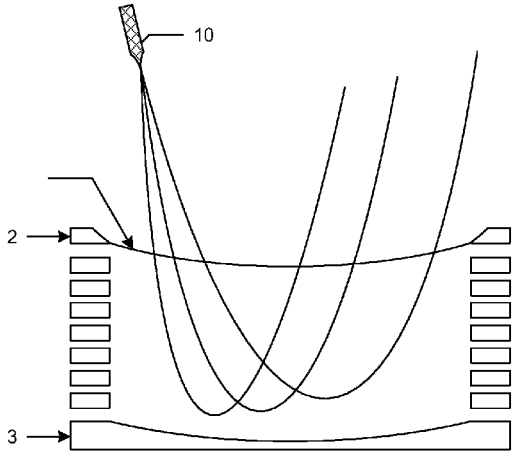
FIG. 2 is a plan view of the reflectron of the present invention showing example paths of ions.

With reference to FIGS. 1 and 2, a reflectron 1 according to the present invention comprises a curved front electrode 2. In this particular embodiment the front electrode 2 is formed in the shape of part of a sphere, such that it has a constant radius of curvature. The front electrode 2 has a concave side 6 and a convex side 7, and has a diameter of approximately 80 mm to 200 mm. The front electrode 2 is comprised of a fine mesh or grid. The mesh allows approximately 90-95% of incident ions to pass through.

A plurality of annular electrodes 4 are arranged behind the front electrode 2, on the convex side 7 of the front electrode 2. The annular electrodes 4 do not incorporate a mesh, but are ring-shaped with a central circular aperture through which the ions can freely pass. The number of these electrodes, their spacing and the voltages on them can vary with the specific design.

In one embodiment, a back electrode 3 is located at the opposite end of the reflectron 1 from the front electrode 2. The back electrode 3 is spaced apart from the front electrode 2 by typically 40 to 100 mm. This distance depends on many factors according to the magnification and time-focusing requirements. The annular electrodes 4 are thus intermediate between the front electrode 2 and back electrode 3.

The back electrode 3 is aligned along a longitudinal axis of the reflectron 1 with the front electrode 2 and annular electrodes 4. The back electrode 3 has an upper surface 5 which is curved in the shape of part of a sphere. The upper surface 5 of the back electrode 3 is preferably concentric with the front electrode 2 and thus has a constant radius of curvature which is greater than the radius of curvature of the front electrode 2. The upper surface 5 is concave, the concave surface 5 facing towards the front electrode 2.

The reflectron 1 is suitable for use in a three-dimensional atom probe as previously described. With reference to FIG. 2, the concave side 6 of the front electrode 2 and the concave upper side of the back electrode 3 are oriented approximately towards an ion source.

The radius of curvature of the front electrode 2 is preferably equal to or smaller than the radius of curvature of the back electrode 3.

In this embodiment, the radius of curvature of the front electrode 2 may be approximately the same as the distance between a detector and the front electrode 2. The radius of curvature of the upper surface 5 of the back electrode 3 may be substantially the same as the distance between the detector and the back electrode 3. The front electrode 2 and the upper surface 5 are each shaped as a part of spheres which may have their centers in proximity to the detector. This arrangement allows the reflectron 1 to spatially focus the ions onto the detector.

Figure 3:
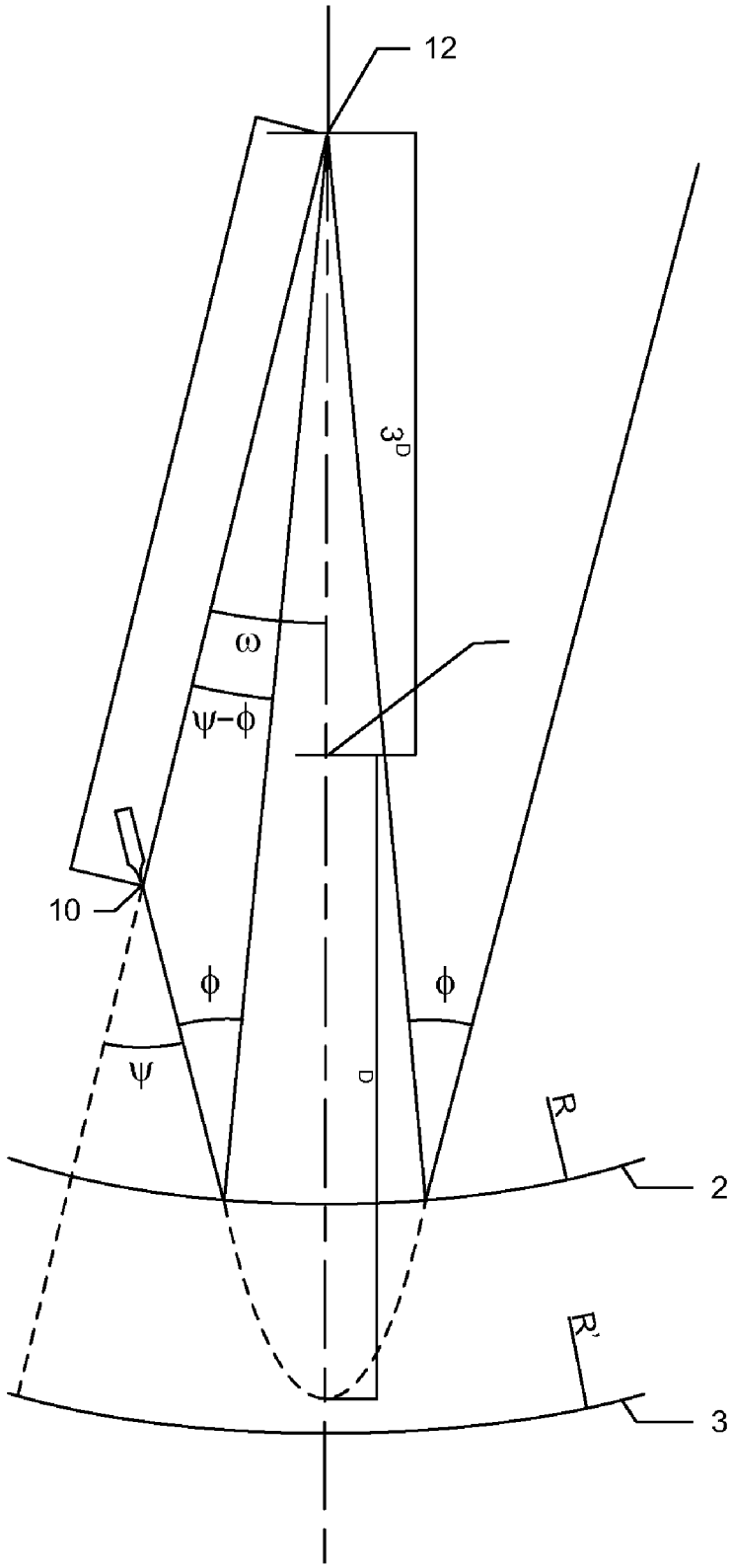
FIG. 3 is a plan view of the reflectron of the present invention showing an example path of an ion.

With reference to FIG. 3, the reflectron 1 achieves spatial focusing of the ions onto a detector when an entry angle $\psi$ is up to approximately 45°. The reflectron 1 is able to reduce the magnification of the three-dimensional atom probe such that the image on the detector corresponds to a much larger area of the sample. The point 12 is the centre of the spheres of the electrodes 2, 3, and the focus of the elliptical path followed by the ions.

Figure 4:
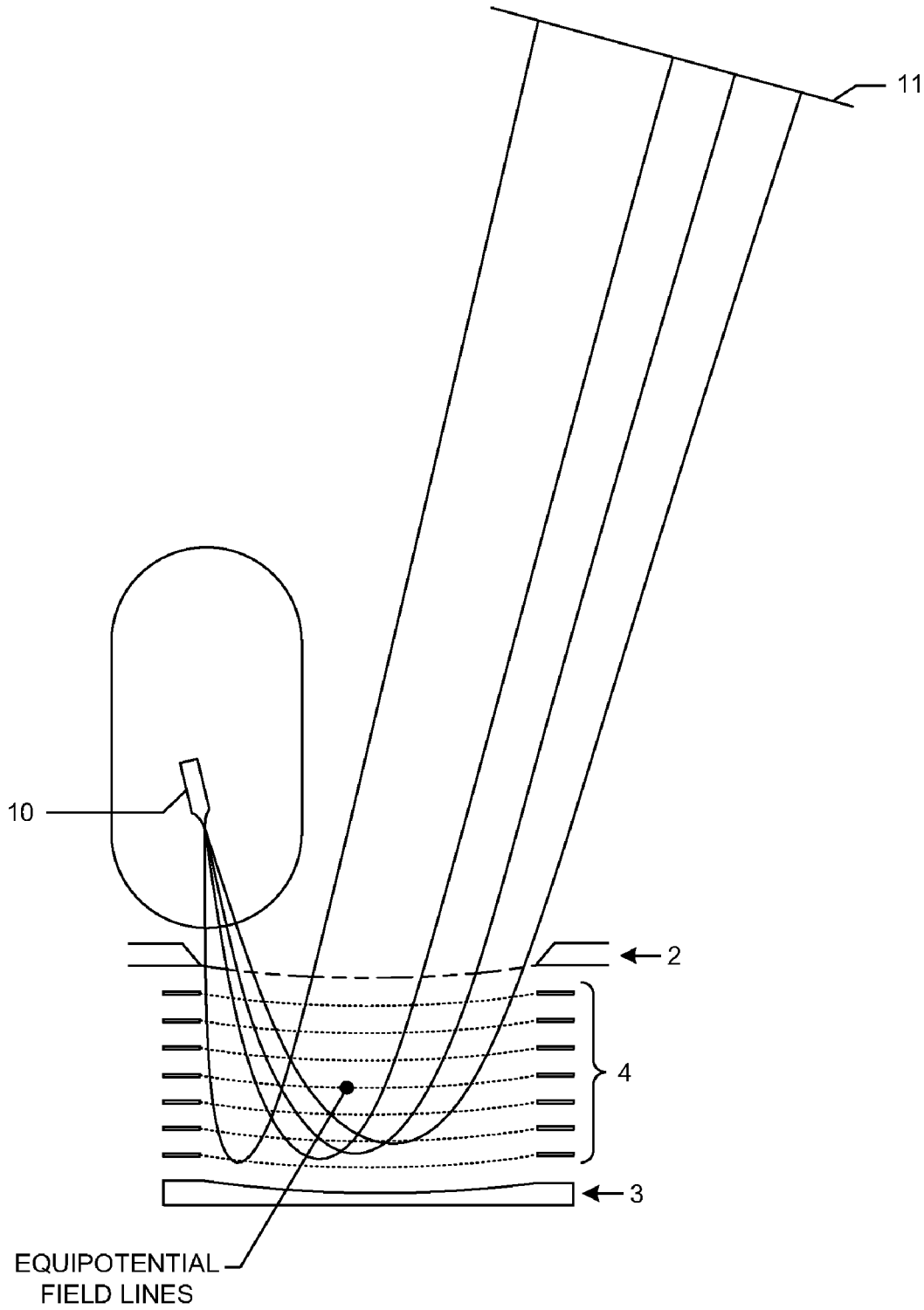
FIG. 4 is a plan view of the reflectron of the present invention showing paths of ions with different initial ion trajectories, hence resolving an image if a position sensitive detector is utilized.

FIG. 4 is a plan view of the reflectron of the present invention showing the different ion trajectory geometries. Within the reflectron 1, the ion follows an elliptical path. A focus of the ellipse is at the centre of curvature of the electrodes. Analytic expressions exist for the major and minor diameters of the ellipse, and the other angles shown for given reflectron parameters and for each angle that the incident ion path makes with a datum line between the specimen tip and the centre of curvature. FIG. 4 shows the position of the detector 11.

The reflectron 1 achieves almost linear space angle focusing of the ions over a wide range of angles, and so is able to reduce the magnification of the three-dimensional atom probe such that the image on the detector corresponds to a much larger area of the sample. The relationship between the angle at which an ion is emitted from the ion source 10, and the position on the detector 11 is substantially linear. This means that the image produced by the detector 11 corresponds to the sample without distortion.

The trajectories in all the figures are calculated from analytic expressions. Analytic expressions are also available for the time the ion spends in the reflectron and the derivative of the time with ion energy. The latter is used to determine the reflectron parameters used to calculate the above trajectories.

Figure 5:
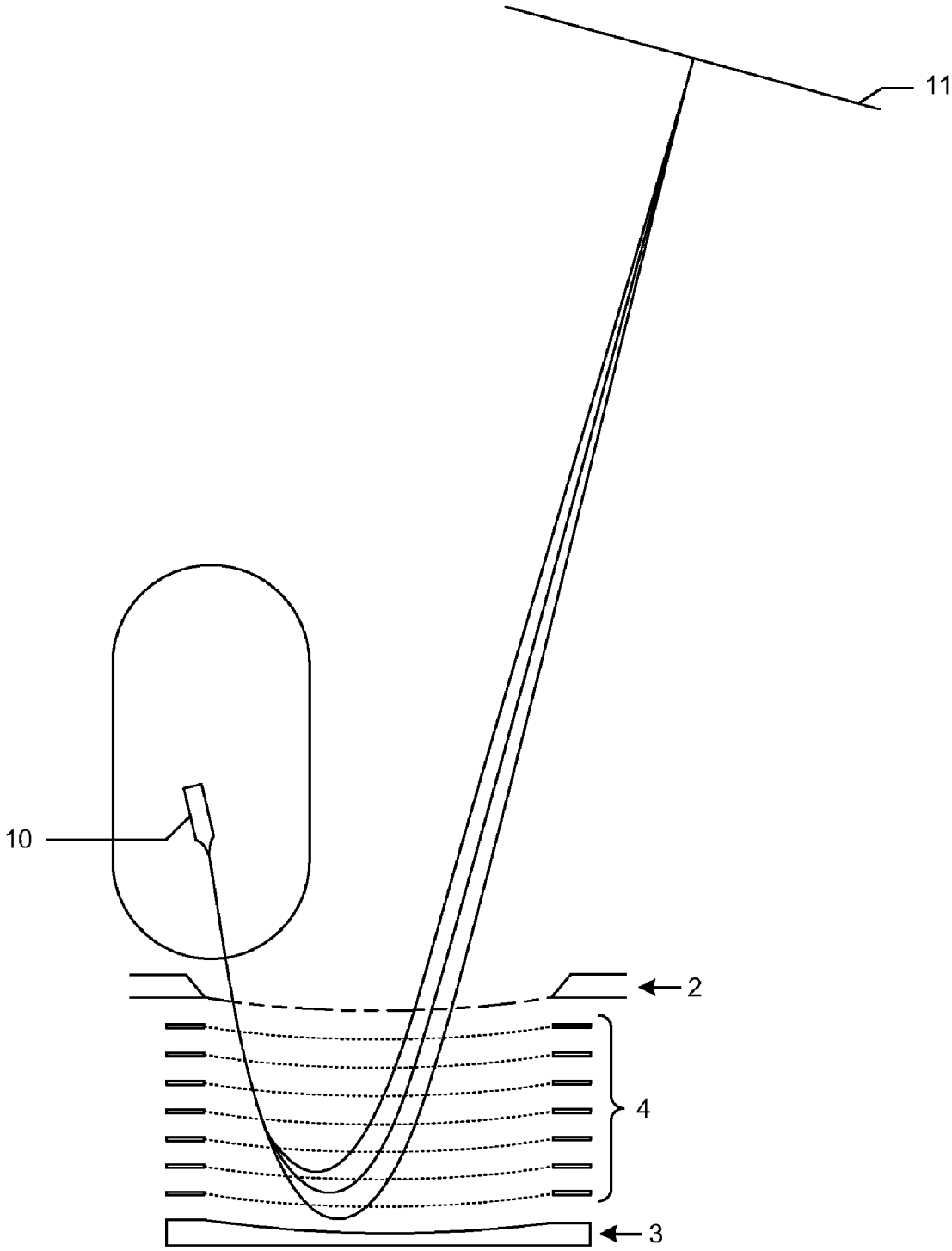
FIG. 5 is a plan view of the reflectron of the present invention showing paths of ions with different initial energies.

FIG. 5 shows example paths of ions emitted at the same angle from the specimen with a range of initial energies. The ions shown have an exaggerated energy variation in the range of +/−10%. Typically, an energy variation in the range +/−1% would be expected.

The ability of the reflectron 1 to focus ions of different energies onto substantially the same position on the detector reduces chromatic aberration. In the concentric configuration embodiment, when the centre of the spheres defined by the front electrode and back electrode are in the same plane as the detector, chromatic aberration can be substantially eliminated.

The reduction in chromatic aberration is possible because the lateral shift in exit position of the ion due to an energy change can be compensated for by the change in exit angle caused by the same energy variation. This occurs when the centre of curvature of the electrodes is near to the position of the detector. With reference to FIG. 3, the entry angle $\phi$ is the same as exit angle $\phi$, which indicates that the position of the ion on the detector is not substantially dependent on the energy of the ion.

The reflectron 1 can accept ions diverging over a relatively large angle. The angle for which the reflectron 1 can perform time focusing and substantially linear spatial focusing of ions with substantially eliminated chromatic aberration is approximately six or seven times greater than for a conventional uniform field reflectron. In addition the reflectron 1 may be overall smaller than a conventional uniform field reflection of the same diameter and for the same external flight distance and still achieve time focusing.

In use, electric potentials are applied to the front electrode 2, back electrode 3 and annular electrodes 4. The potential applied to the back plate 3 is greater than the equivalent energy of the ions which are to be measured. This ensures that the ions are reflected back towards the source of the ions before they reach the back electrode 3.

The potentials applied to all the electrodes are calculated to ensure that the field within the reflectron is always directed radially away from the centre of curvature. The annular electrodes maintain the correct potentials to minimize the edge effect caused by the fact that the front and back electrodes are only partial spheres.

In this embodiment the intermediate, annular electrodes 4 are spaced and held at appropriate voltages to ensure that the field inside the reflectron is as closely as possible equivalent to that which would be generated by a theoretical point charge of suitable value located at the centre of curvature. The annular electrodes 4 are each held at the potential which would be present at their location due to the point charge which the reflectron 1 aims to simulate.

In this embodiment the equipotential field lines 13 are curved and substantially in the shape of part of a sphere. The field generated by the reflectron 1 approximately mimics the field which would be generated by a point charge located at the centre of the spheres defined by the front and back electrodes. The centre of the spheres defined by the front and back electrodes is preferably in proximity to the detector. The centre of the spheres defined by the front and back electrodes may be at approximately the same distance from the electrodes 2, 3 as the detector is from the respective electrodes 2, 3. The centre of the spheres defined by the front and back electrodes preferably will not coincide with the detector, if the detector is offset from the axis of the electrodes 2, 3. Since the reflectron 1 substantially simulates a point charge, ions in the reflectron move in an ellipse.

An ion from the ion source 10 first passes through the mesh of the front electrode 2. The path of the ion is altered by the non-uniform electric potential it experiences. The ion passes through the central aperture of at least some of the annular electrodes 4. The electric potential the ion continues to experience within the reflectron 1 causes its speed in the direction of an axis of its elliptical orbit to reduce to zero, before the ion reaches the back plate 3. The electric potential applied to the back plate 3, annular rings 4 and front electrode 2 causes the ion to accelerate back towards the front electrode 2 and away from the back plate 3. The ion then passes back through the annular electrodes 4 and front electrode 2 and continues until it hits the detector.

The time taken by the ion to travel from a point adjacent the ion source to the detector is measured, and used to calculate the mass/charge ratio of the ion. The identity of the ion is determined by reference to known values for the mass/charge ratio of ions.

Typically the mesh is at ground potential and the back electrode is held at a potential equal to typically approximately 1.08 times the nominal energy of the ions. This insures that the ions do not penetrate too deeply and collide with the back plate of the reflectron. In practice the amount of potential required will vary with the specific configuration of the device and may not be constant. The annular electrodes are held at intermediate potentials between the potential of the front electrode 2 and back electrode 3. The potential of the annular electrodes 4 increases towards the back electrode 3. The potentials of the annular electrodes 4 are calculated to maintain a substantially radial field at the edges of the reflectron 1. The annular electrodes thus compensate for the front and back electrodes 2,3 forming only part of a sphere, and not a complete sphere.

The reflectron of the present invention may be used in a time-of-flight mass spectrometer, atom probe or a three-dimensional atom probe.

The front electrode is described as a mesh or grid. Alternatively, it may be formed from a solid material with holes or may be replaced by an electrostatic lens arrangement consisting of further annular electrodes held at different voltages.

The back electrode is described as spherically curved, however, the back electrode could also have a different type of curvature or be planar. The curvature of the front electrode could also not be constant. The front and/or rear electrodes may be ellipsoidal. Typically the shape of the front electrode has a greater effect on an ion trajectory than the back electrode, and so a planar back electrode could be utilized. Alternatively, a planar front electrode could be used with a curved back electrode. The front electrode and back electrode are therefore not necessarily concentric.

The centers of the spheres defined by the front electrodes and back electrodes have been described as being adjacent to or in proximity to the detector. Alternatively, the centre of the spheres defined by the front electrodes and back electrodes may be located away from the detector. Thus, the radius of curvature of the front electrode and/or the rear electrode does not necessarily substantially equal the distance from that electrode to the detector.

The invention claimed is:

1. A reflectron for deflecting an ion from a specimen in a time-of-flight mass spectrometer, comprising:

a front electrode; and a back electrode;

with an ion flight path extending at least partially therebetween;

wherein at least one of the front and back electrodes is capable of generating a curved electric field intersecting the ion flight path;

the front and back electrodes are configured to perform time focusing and resolve an image of a specimen.

2. The reflectron of claim 1 wherein the front electrode has a concave surface facing the ion source.

3. The reflectron of claim 2 wherein the back electrode has a concave surface facing the ion source.

4. The reflectron of claim 2 wherein a concave surface of the front electrode is curved with a constant radius of curvature.

5. The reflectron of claim 3 wherein a concave surface of the back electrode is curved with a constant radius of curvature.

6. The reflectron of claim 2 wherein, in use, when incorporated in a time-of-flight mass spectrometer, the radius of curvature of the front electrode is substantially equal to a distance between the front electrode and a detector for detecting ions in the time-of-flight mass spectrometer.

7. The reflectron of claim 3 wherein, in use, when incorporated in a time-of-flight mass spectrometer, the radius of curvature of the back electrode is substantially equal to a distance between the back electrode and a detector for detecting ions in the time-of-flight mass spectrometer.

8. The reflectron of claim 3 wherein a radius of curvature of the front electrode and a radius of curvature of the back electrode are such that the two electrodes are concentric.

9. The reflectron of claim 1 wherein the front electrode and back electrode are configured such that when an electric potential is applied to at least one of the electrodes an electric field is generated substantially equivalent to an electric field produced by a point charge.

10. The reflectron of claim 1 wherein a plurality of intermediate electrodes are disposed between the front electrode and the back electrode.

11. The reflectron of claim 10 wherein each of the intermediate electrodes are held at an electric potential equivalent to the potential at their location which would be generated by the point charge simulated by the front electrode and back electrode.

12. The reflectron of claim 10 wherein each of the intermediate electrodes are formed as an annulus.

13. The reflectron of claim 1 wherein the front electrode is held at ground potential.

14. The reflectron of claim 1 wherein the back electrode is held at a potential relative to the front electrode of approximately 1.08 times the mean energy of ions to be reflected.

15. The reflectron of claim 1 wherein the front electrode comprises a mesh.

16. The reflectron of claim 3 wherein the back electrode comprises a plate.

17. A time-of-flight mass spectrometer comprising a reflectron as defined in claim 1.

18. A time-of-flight mass spectrometer employing a reflectron as defined in claim 1, wherein:

the front electrode has a concave surface having a constant radius of curvature; and the radius of curvature of the front electrode is substantially equal to a distance between the front electrode and a detector for detecting ions in the time-of-flight mass spectrometer.

19. The time-of-flight mass spectrometer of claim 18 wherein:

the back electrode has a concave surface having a constant radius of curvature; and the radius of curvature of the back electrode is substantially equal to a distance between the back electrode and a detector for detecting ions in the time-of-flight mass spectrometer.

20. The reflectron of claim 1 wherein the electrodes are positioned to minimize chromatic aberration.

21. The reflectron of claim 18 wherein the time-of-flight mass spectrometer is an atom probe.

* * * * *